US008992769B2

(12) United States Patent
O'Rear et al.

(10) Patent No.: US 8,992,769 B2
(45) **Date of Patent: *Mar. 31, 2015**

(54) PROCESS, METHOD, AND SYSTEM FOR REMOVING HEAVY METALS FROM FLUIDS

(71) Applicant: Chevron U.S.A. Inc., San Ramon, CA (US)

(72) Inventors: Dennis John O'Rear, Petaluma, CA (US); Russell Evan Cooper, Fairfield, CA (US); Sujin Yean, Houston, TX (US); Stephen Harold Roby, Hercules, CA (US); Hosna Mogaddedi, Fremont, CA (US); Manuel Eduardo Quintana, Sugarland, TX (US); Jerry Max Rovner, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 56 days.

This patent is subject to a terminal disclaimer.

(21) Appl. No.: 13/895,983

(22) Filed: May 16, 2013

(65) Prior Publication Data

US 2013/0306521 A1 Nov. 21, 2013

Related U.S. Application Data

(60) Provisional application No. 61/647,703, filed on May 16, 2012.

(51) Int. Cl.
*C10G 17/02* (2006.01)
*C10G 17/08* (2006.01)
(Continued)

(52) U.S. Cl.
CPC ..... *C10G 29/205* (2013.01); *C10G 29/02* (2013.01); *C10G 29/06* (2013.01); *C10G 29/20* (2013.01);
(Continued)

(58) Field of Classification Search
CPC ..... C10G 27/02; C10G 27/04; C10G 27/12; C10G 27/14; C10G 53/14
USPC ..... 208/251 H, 251 R, 252, 253
See application file for complete search history.

(56) References Cited

U.S. PATENT DOCUMENTS 3,083,764 A 4/1963 Gaskell et al.
3,873,581 A 3/1975 Fitzpatrick et al.
(Continued)

OTHER PUBLICATIONS

Pending application U.S. Appl. No. 12/109,194, filed Apr. 24, 2008.
(Continued)

*Primary Examiner* — Walter D Griffin
*Assistant Examiner* — Derek Mueller

(57) ABSTRACT

Trace amount levels of heavy metals such as mercury in crude oil are reduced by contacting the crude oil with a sufficient amount of a reducing agent to convert at least a portion of the non-volatile mercury into a volatile form of mercury, which can be subsequently removed by any of stripping, scrubbing, adsorption, and combinations thereof. In one embodiment, at least 50% of the mercury is removed. In another embodiment, the removal rate is at least 99%. In one embodiment, the reducing agent is selected from sulfur compounds containing at least one sulfur atom having an oxidation state less than +6; ferrous compounds; stannous compounds; oxalates; cuprous compounds; organic acids which decompose to form $CO_2$ and/or $H_2$ upon heating; hydroxylamine compounds; hydrazine compounds; sodium borohydride; diisobutylaluminium hydride; thiourea; transition metal halides; and mixtures thereof.

28 Claims, 1 Drawing Sheet

(51) Int. Cl.

| | |
|---|---|
| ***C10G 29/06*** | (2006.01) |
| ***C10G 29/10*** | (2006.01) |
| ***C10G 29/12*** | (2006.01) |
| ***C10G 53/04*** | (2006.01) |
| ***C10G 29/20*** | (2006.01) |
| ***C10G 29/02*** | (2006.01) |
| ***C10G 29/22*** | (2006.01) |
| ***C10G 53/08*** | (2006.01) |

(52) U.S. Cl.

CPC ..... *C10G 29/22* (2013.01); *C10G 53/04* (2013.01); *C10G 53/08* (2013.01); *C10G 2300/201* (2013.01)

USPC ..... 208/251 R; 208/252; 208/253

(56) References Cited

U.S. PATENT DOCUMENTS

| | | | |
|---|---|---|---|
| 4,028,236 | A | 6/1977 | Townsend et al. |
| 4,094,098 | A | 6/1978 | Gourley |
| 4,094,777 | A | 6/1978 | Sugier et al. |
| 4,108,769 | A | 8/1978 | Krieg et al. |
| 4,133,755 | A | 1/1979 | Tarao et al. |
| 4,149,598 | A | 4/1979 | Christian |
| 4,151,077 | A | 4/1979 | Nogueira et al. |
| 4,167,481 | A | 9/1979 | Cremers et al. |
| 4,230,486 | A | 10/1980 | Capuano et al. |
| 4,336,237 | A | 6/1982 | Kudryk et al. |
| 4,338,288 | A | 7/1982 | Rollmann |
| 4,354,942 | A | 10/1982 | Kaczur et al. |
| 4,551,237 | A | 11/1985 | Fenton |
| 4,578,195 | A | 3/1986 | Moore et al. |
| 4,619,744 | A | 10/1986 | Horton |
| 4,678,584 | A | 7/1987 | Elfline |
| 4,708,853 | A | 11/1987 | Matviya et al. |
| 4,709,118 | A | 11/1987 | Yan |
| 4,752,397 | A | 6/1988 | Sood |
| 4,876,025 | A | 10/1989 | Roydhouse |
| 4,877,515 | A | 10/1989 | Audeh |
| 4,880,527 | A | 11/1989 | Audeh |
| 4,902,662 | A | 2/1990 | Toulhoat et al. |
| 4,915,818 | A | 4/1990 | Yan |
| 4,981,577 | A | 1/1991 | Audeh et al. |
| 4,985,389 | A | 1/1991 | Audeh |
| 5,034,203 | A | 7/1991 | Audeh et al. |
| 5,037,552 | A | 8/1991 | Furuta et al. |
| 5,107,060 | A | 4/1992 | Yan |
| 5,110,480 | A | 5/1992 | Yan |
| 5,173,286 | A | 12/1992 | Audeh |
| 5,202,301 | A | 4/1993 | McNamara |
| 5,238,488 | A | 8/1993 | Wilhelm |
| 5,304,693 | A | 4/1994 | Boitiaux et al. |
| 5,336,835 | A | 8/1994 | McNamara |
| 5,360,632 | A | 11/1994 | Johnson et al. |
| 5,407,009 | A | 4/1995 | Butler et al. |
| 5,961,821 | A | 10/1999 | Varadaraj et al. |
| 6,268,543 | B1 | 7/2001 | Sakai et al. |
| 6,350,372 | B1 | 2/2002 | Degnan et al. |
| 6,403,044 | B1 | 6/2002 | Litz et al. |
| 6,475,451 | B1 | 11/2002 | Leppin et al. |
| 6,521,131 | B1 | 2/2003 | Hamilton et al. |
| 6,685,824 | B2 | 2/2004 | Frankiewicz et al. |
| 6,866,048 | B2 | 3/2005 | Mattox |
| 6,906,398 | B2 | 6/2005 | Yeo et al. |
| 6,960,291 | B2 | 11/2005 | Greaney et al. |
| 7,037,474 | B2 | 5/2006 | Nolan et al. |
| 7,093,655 | B2 | 8/2006 | Atkinson |
| 7,591,944 | B2 | 9/2009 | Carnell et al. |
| 7,666,318 | B1 | 2/2010 | Lehtinen et al. |
| 7,744,763 | B2 | 6/2010 | Cross et al. |
| 7,775,278 | B2 | 8/2010 | Willberg et al. |
| 2005/0263739 | A1 | 12/2005 | Mattox et al. |
| 2006/0048646 | A1 | 3/2006 | Olson et al. |
| 2007/0246426 | A1 | 10/2007 | Collins |
| 2008/0196892 | A1 | 8/2008 | Lau et al. |
| 2008/0283470 | A1 | 11/2008 | Gustafsson et al. |
| 2009/0095684 | A1* | 4/2009 | Kanatzidis et al. ..... 210/688 |
| 2009/0114247 | A1 | 5/2009 | Brown et al. |
| 2009/0261040 | A1 | 10/2009 | Pruet |
| 2009/0288825 | A1 | 11/2009 | Tang |
| 2009/0304563 | A1 | 12/2009 | Harada et al. |
| 2009/0308609 | A1 | 12/2009 | Curole et al. |
| 2010/0000910 | A1 | 1/2010 | Gallup et al. |
| 2010/0025184 | A1 | 2/2010 | Shibuya et al. |
| 2010/0032344 | A1 | 2/2010 | Cross et al. |
| 2010/0032345 | A1 | 2/2010 | Cross et al. |
| 2010/0078358 | A1 | 4/2010 | Tullos et al. |
| 2010/0099596 | A1 | 4/2010 | Trahan |
| 2010/0126909 | A1 | 5/2010 | Bhasin et al. |
| 2010/0147742 | A1 | 6/2010 | Ozum |
| 2010/0155330 | A1 | 6/2010 | Burba et al. |
| 2010/0175896 | A1 | 7/2010 | Owen |
| 2010/0200477 | A1 | 8/2010 | Varadi et al. |
| 2010/0320124 | A1 | 12/2010 | Zhang et al. |
| 2011/0163008 | A1 | 7/2011 | Zhang et al. |
| 2011/0253375 | A1 | 10/2011 | Jamaluddin et al. |
| 2012/0073811 | A1 | 3/2012 | Mock |

OTHER PUBLICATIONS

Pending application U.S. Appl. No. 12/132,475, filed Jun. 3, 2008.
Pending application U.S. Appl. No. 12/167,466, filed Jul. 3, 2008.
Pending application U.S. Appl. No. 12/883,578, filed Sep. 16, 2010.
Pending application U.S. Appl. No. 12/883,921, filed Sep. 16, 2010.
Pending application U.S. Appl. No. 12/883,971, filed Sep. 16, 2010.
Pending application U.S. Appl. No. 12/883,995, filed Sep. 16, 2010.
Pending application U.S. Appl. No. 12/950,060, filed Nov. 19, 2010.
Pending application U.S. Appl. No. 12/950,170, filed Nov. 19, 2010.
Pending application U.S. Appl. No. 12/950,637, filed Nov. 19, 2010.
Pending application U.S. Appl. No. 13/299,436, filed Nov. 16, 2011.
Pending application U.S. Appl. No. 13/804,172, filed Mar. 14, 2013.
Pending application U.S. Appl. No. 13/804,430, filed Mar. 14, 2013.
Pending application U.S. Appl. No. 13/804,662, filed Mar. 14, 2013.
Pending application U.S. Appl. No. 13/826,213, filed Mar. 14, 2013.
Pending application U.S. Appl. No. 13/895,612, filed May 16, 2013.
Pending application U.S. Appl. No. 13/895,754, filed May 16, 2013.
Pending application U.S. Appl. No. 13/895,850, filed May 16, 2013.
Pending application U.S. Appl. No. 13/896,242, filed May 16, 2013.
Pending application U.S. Appl. No. 13/896,255, filed May 16, 2013.
Ashworth, S. C., "Mercury Removal at Idaho National Engineering and Environmentally Laboratory's New Waste Calciner Facility," *Waste Management*, Feb. 27-Mar. 2, 2000, INEEL, Bechtel BWXT Idaho, LLC, Tucson, AZ, pp. 1-20.
Campanella et al., "Mercury Removal from Petrochemical Wastes," *Water Research*, 1986, vol. 20, No. 1, pp. 63-65.
Carnell et al., "Mercury Matters," *Hydrocarbon Engineering*, Dec. 2005, 3 pages.
Chaiyasit et al., "Decontamination of Mercury Contaminated Steel (API 5L-X52) Using Iodine and Iodide Lixiviant," *Modern Applied Science*, Jan. 2010, vol. 4, No. 1, pp. 12-20.
Clever et al., "The Solubility of Mercury and Some Sparingly Soluble Mercury Salts in Water and Aqueous Electrolyte Solutions," *Journal of Physical and Chemical Reference Data*, 1895, vol. 14, No. 3, pp. 631-680.
Corvini et al., "Mercury Removal from Natural Gas and Liquid Streams," *UOP LLC*, 2002, Houston, TX, pp. 1-9.
Findlay et al., "Removal of Elemental Mercury from Wastewaters Using Polysulfides," *Environmental Science and Technology*, Nov. 1981, vol. 15, No. 11, pp. 1388-1390.
Gildert et al., "Mercury Removal from Liquid Hydrocarbons in Ethylene Plants," *AIChE Paper. No. 135c*, Mar. 24, 2010, Spring National Meeting, San Antonio, TX, 14 pages.
Kim et al., "Demulsification of Water-In-Crude Oil Emulsions by a Continuous Electrostatic Dehydrator," *Separation Science and Technology*, 2002, vol. 37, No. 6, pp. 1307-1320.
Larson et al., "Mass-Transfer Model of Mercury Removal from Water via Microemulsion Liquid Membranes," *Industrial & Engineering Chemist Research*, 1994, vol. 33, No. 6, pp. 1612-1619.

(56) References Cited

OTHER PUBLICATIONS

Lemos et al., "Demusification of Water-in-Crude Oil Emulsions Using Ionic Liquids and Microwave Irradiation," *Energy Fuels*, 2010, vol. 24, pp. 4439-4444.

Morel et al., "The Chemical Cycle and Bioaccumulation of Mercury," *Annual Review Ecology, Evolution, and Systematics*, 1998, vol. 29, pp. 543-566.

Núñez et al., "Leaching of Cinnabar with HCI-Thiourea Solutions as the Basis of a Process for Mercury Obtention," *Metallurgical Transactions B*, Sep. 1996, vol. 17B, pp. 443-448.

Sharma et al., "Chemical Demulsification ofNatural Petroleum Emulsions of Assam (India)," *Colloid & Polymer Science*, 1982, vol. 260, pp. 616-622.

Sizeneva et al., "Applied Electrochemistry and Corrosion Protection of Metals: Mercury Passivation Solutions of Potassium Chloride and Sodium Hydroxide and Hypochlorite," *Russian Journal of Applied Chemistry*, 2009, vol. 82, No. 1, pp. 52-56.

Sizeneva et al., "Inorganic Synthesis and Industrial Inorganic Chemistry: A Study of Mercury Dissolution in Aqueous Solutions of Sodium Hypochlorite," *Russian Journal of Applied Chemistry*, 2005, vol. 78, No. 4, pp. 546-548.

Venkatesan et al., "Removal of Complexed Mercury by Dithiocarbamate Grafted on Mesoporous Silica," *Journal of Radioanalytical and Nuclear Chemistry*, 2003, vol. 256, No. 2, pp. 213-218.

Waldo, John H., "Some New Water-Soluble Organo-Mercury Compounds," *Water Soluble Organo Compounds*, Mar. 6, 1931, vol. 53, pp. 992-996.

Wasay et al., "Remediation of a Soil Polluted by Mercury with Acidic Potassium Iodide," *Journal of Hazardous Materials*, 1995, vol. 44, pp. 93-102.

Yuan et al., "Fractions and Leaching Characteristics of Mercury in Coal," *Environmental Monitoring and Assessment*, Jan. 6, 2009, vol. 167, pp. 581-586.

Zhao et al., "Removal of Elemental Mercury by Sodium Chlorite Solution," *Chemical Engineering & Technology*, 2008, vol. 31, No. 3, pp. 350-354.

* cited by examiner

PROCESS, METHOD, AND SYSTEM FOR REMOVING HEAVY METALS FROM FLUIDS

CROSS-REFERENCE TO RELATED APPLICATIONS

This application claims benefit under 35 USC 119 of U.S. Patent Application Ser. No. 61/647,703 with a filing date of May 16, 2012. This application claims priority to and benefits from the foregoing, the disclosures of which are incorporated herein by reference.

TECHNICAL FIELD

The invention relates generally to a process, method, and system for removing heavy metals such as mercury from hydrocarbon fluids such as crude oil.

BACKGROUND

Heavy metals such as lead, zinc, mercury, silver, arsenic can be present in trace amounts in all types of hydrocarbon streams such as crude oils. The amount can range from below the analytical detection limit to several thousand ppbw (parts per billion by weight) depending on the source. It is desirable to remove the trace amounts of these metals from crude oils.

Various methods to remove trace metal contaminants in liquid hydrocarbon feed such as mercury have been disclosed. In U.S. Pat. No. 6,350,372 B1, a liquid hydrocarbon feed is mixed with a miscible sulfur compound and then placed in contact with a fixed bed absorbent for removal of at least a portion of the mercury on an elemental basis. U.S. Pat. No. 4,474,896 discloses the use of absorbent compositions, e.g., polysulfide based, for removal of elemental mercury ($Hg^0$) from gaseous and liquid hydrocarbon streams. U.S. Pat. Publication Nos. 2010/0032344 and US2010/0032345 describe processes to remove elemental mercury $Hg^0$ from crude oil consisting of stripping the mercury-contaminated crude with gas in a heated vessel, and then removing the mercury from the stripped gas in an adsorption bed.

There are also a number of commercially available processes and products for the removal of elemental mercury $Hg^0$ from hydrocarbon streams including but not limited to ICI Synetix' Merespec™ fixed bed absorbents, UOP's HgSIV™ HgSIV™ regenerative mercury removal adsorbents, and Johnson Matthey's Puraspec™ and Puracare™ granulated absorbents for the removal of mercury from naphtha and/or gaseous hydrocarbon streams.

US Patent Application Nos. 2010/0032344 and 2010/0032345 disclose a process for removing elemental mercury concentration with a liquid/gas contactor, with simulations showing 90% mercury removal at a pressure from <1 to −3 Bars and a temperature of greater than 150° C., conditions common at crude oil well sites. It is indicated that the liquid/gas contact is carried out in a vessel that provides direct contact of the treated gas stream with the liquid hydrocarbon stream without contacting any other materials or devices, giving 90% removal rate.

Studies have been conducted to measure mercury levels in crude oil as well as the percentage of mercury in the forms of particles, which can be removed by filtration or centrifugation. It was shown that in crude oils containing more than 50 ppbw mercury, the percent mercury in particles which can be removed by laboratory filtration or centrifugation is over 25% with an average of 73%. It is believed that the remaining 27% mercury is primarily in the form of fine particles. It was also shown that in most samples of crude oils and condensates, the predominant form of mercury is non-volatile, and not in the form of elemental mercury $Hg^0$ which is volatile. It is well known in the art that volatile mercury is readily removed from hydrocarbons upon stripping or sparging with a low mercury gas stream. Quantitative Reitveld XRD analysis of the recovered solids from a crude sample show the only mercury phase to be meta-cinnabar (HgS) and this is assumed to be the predominant mercury species in crude oil.

As adsorption technology does not work well for crude oils and condensates with low levels of mercury, and particularly crude oils containing the non-volatile form of mercury, which has not been well addressed in the prior art. There is a need for improved methods for the removal of mercury from liquid hydrocarbon steams, particularly non-volatile form of mercury.

SUMMARY OF THE INVENTION

In one aspect, the invention relates to an improved method to treat a crude oil to reduce its mercury concentration. The method comprises: mixing an effective amount of a reducing agent with the crude oil feed to convert at least a portion of the non-volatile mercury into a volatile mercury; and removing the volatile mercury by at least one of stripping, scrubbing, adsorption, and combinations thereof to obtain a crude oil having a reduced concentration of mercury which is less than 50% of the first concentration of mercury.

In another aspect, the invention relates to an improved process to removal mercury from a crude oil stream containing mercury. In the process to be improved, the process comprises the steps of: a) providing a crude oil stream containing mercury; b) separating the crude oil stream into a gaseous hydrocarbon stream comprising hydrocarbons, mercury and water, and a liquid hydrocarbon stream comprising hydrocarbons and volatile mercury; c) charging a mercury-containing gas feed, including in part at least a portion of the gaseous hydrocarbon stream, to a mercury removal unit for removal of mercury from the mercury-containing gas feed, thereby forming a treated gas stream; d) contacting a recycle gas stream comprising a portion of the treated gas stream with at least a portion of said liquid hydrocarbon stream for transfer of at least a portion of the elemental mercury contained in the liquid hydrocarbon stream to the recycle gas stream; thereby forming a mercury rich gas stream, and a treated liquid hydrocarbon stream; and e) passing the mercury rich gas stream to the mercury removal unit as a portion of the mercury-containing gas feed. The improvement comprises converting at least at portion of the mercury in the crude oil stream into volatile mercury, wherein the improvement comprising mixing an effective amount of a reducing agent with the crude oil stream to convert at least a portion of the mercury into a volatile mercury; and wherein the mixing into the crude oil stream is prior to separating the crude oil stream into a gaseous hydrocarbon stream and a liquid hydrocarbon stream.

DETAILED DESCRIPTION

Figure 1:
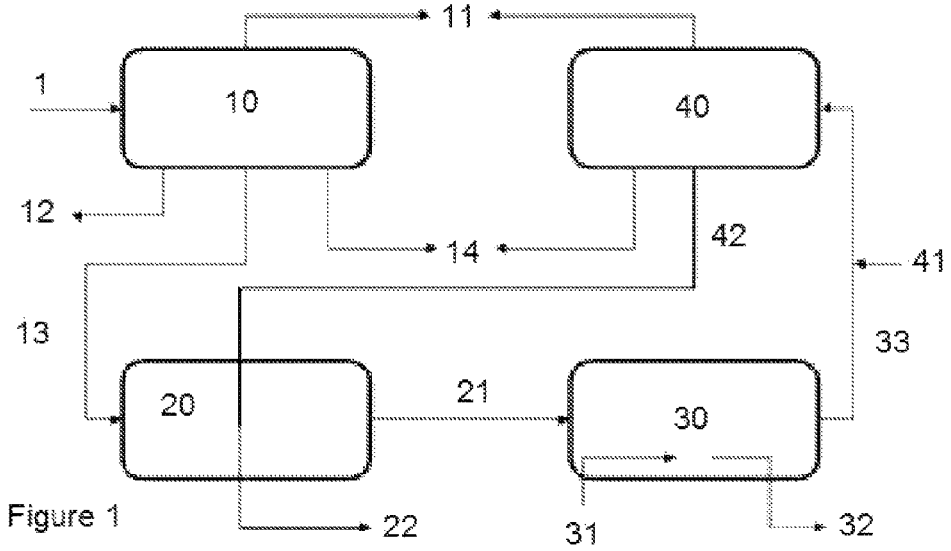
FIG. 1 is a block diagram illustrating the removal of mercury from crude oil as practiced on a FPSO.

The following terms will be used throughout the specification and will have the following meanings unless otherwise indicated.

"Crude oil" refers to a liquid hydrocarbon material. As used herein, the term crude refers to both crude oil and condensate. Crude, crude oil, crudes and crude blends are used interchangeably and each is intended to include both a single crude and blends of crudes. "Hydrocarbon material" refers to a pure compound or mixtures of compounds containing hydrogen and carbon and optionally sulfur, nitrogen, oxygen, and other elements. Examples include crude oils, synthetic crude oils, petroleum products such as gasoline, jet fuel, diesel fuel, lubricant base oil, solvents, and alcohols such as methanol and ethanol.

"Heavy metals" refers to gold, silver, mercury, osmium, ruthenium, uranium, cadmium, tin, lead, and arsenic. In one embodiment, "heavy metals" refers to mercury.

"Trace amount" refers to the amount of heavy metals in the crude oil. The amount varies depending on the crude oil source and the type of heavy metal, for example, ranging from a few ppb to up to 100,000 ppb for mercury and arsenic.

"High mercury crude" refers to a crude with 50 ppbw or more of mercury, e.g., 100 ppbw or more of mercury; or 250 ppbw or more of mercury.

"Mercury sulfide" may be used interchangeably with HgS, referring to mercurous sulfide, mercuric sulfide, or mixtures thereof. Normally, mercury sulfide is present as mercuric sulfide with a stoichiometric equivalent of approximately one mole of sulfide ion per mole of mercury ion. Mercury sulfide can be in any form of cinnabar, meta-cinnabar, hyper-cinnabar and combinations thereof.

"Percent volatile mercury" in one embodiment is measured by stripping 15 ml of crude or condensate with 300 ml/min of nitrogen ($N_2$) for one hour. For samples which are fluid at room temperature, the stripping is carried out at room temperature. For samples which have a pour point above room temperature, but below 60° C., the stripping is done at 60° C. For samples which have a pour point above 60° C., the stripping is at 10° C. above the pour point.

"Predominantly non-volatile (mercury)" in the context of crudes refers crudes for which less than 50% of the mercury can be removed by stripping, e.g., less than 25% of the mercury can be removed by stripping; or less than 15%.

"Percent particulate mercury" refers to the portion of mercury that can be removed from the crude oil by centrifugation or filtration. After the centrifugation the sample for mercury analysis is obtained from the middle of the hydrocarbon layer. The sample is not taken from sediment, water or rag layers. The sample is not shaken or stirred after centrifugation. In one embodiment, percent particulate mercury is measured by filtration using a 0.45 micron filter or by using a modified sediment and water (BS&W) technique described in ASTM D4007-11. The sample is heated in accordance with the procedure. If the two methods are in disagreement, the modified basic BS&W test is used. The modifications to the BS&W test includes: omission of dilution with toluene; demulsifier is not added; and the sample is centrifuged two times with the water and sediments values measured after each time. If the amount of sample is small, the ASTM D4007-11 procedure can be used with smaller centrifuge tubes, but if there is disagreement in any of these methods, the modified basic BS&W test is used with the centrifuge tubes specified in ASTM D4007-11.

"Halogens" refers to diatomic species from the column of the periodic table headed by fluorine, for example $F_2$, $Cl_2$, $Br_2$, $I_2$, etc.

"Halogen oxides" refers to molecules which combine one or more halogen atoms and oxygen, for example NaClO, $ClO_2$, $NaClO_4$.

"Hg-particulate crude" refers to a crude that contains 25% or more of its mercury content as particulate mercury.

"Predominantly Hg-particulate crude" refers to a crude that contains 50% or more mercury as particulate mercury, e.g., crudes with >65% or more mercury as particulate mercury; or >75% or more mercury as particulate mercury, or >90% or more mercury as particulate mercury.

"Organic peracids" refers to multiple-carbon organic compounds where the —OH in an acid group has been replaced with a —OOH group, e.g. a compound of the general formula RCO—OOH. Examples include but are not limited to peracetic acid, perbenzoic acid, meta-chloroperoxybenzoic acid and combinations thereof.

"Inorganic peracids" refers to compounds of sulfur, phosphorous, or carbon where the —OH in an acid group has been replaced with a —OOH group. Examples include but are not limited to peroxydiphosphoric acid, $H_4P_2O_8$ and peroxydisulfuric acid, $H_2S_2O_8$, sodium percarbonate $Na_2CO_3.1.5H_2O_2$, sodium peroxydisulfate $Na_2S_2O_8$, potassium peroxydisulfate $K_2S_2O_8$, ammonium peroxydisulfate $(NH_4)_2S_2O_8$, and combination thereof.

The crude oil containing small amounts of heavy metals such as mercury has a specific gravity of at least 0.75 at a temperature of 60° F. in one embodiment; at least 0.85 in a second embodiment; and at least 0.90 in a third embodiment. In one embodiment, the crude oil is in the form of a mixture of crude oil and water produced from a hydrocarbon reservoir, or from a production well. For some sources, the crude stream to be treated may contain little if any produced water. For some other sources, the amount of produced water can be as much as 98% of the crude stream to be treated. Crude oil feed to be treated refers to both crude oil by itself as well as crude oil-water mixtures.

In one embodiment, the mercury may be present in the crude oil feed as elemental mercury $Hg^0$, ionic mercury, inorganic mercury compounds, and/or organic mercury compounds. Examples include but are not limited to: mercuric halides (e.g., HgXY, X and Y could be halides, oxygen, or halogen-oxides), mercurous halides (e.g., $Hg_2XY$, X and Y could be halides, oxygen, or halogen-oxides), mercuric oxides (e.g., HgO), mercuric sulfide (e.g., HgS, meta-cinnabar hyper-cinnabar and/or cinnabar), mercuric sulfate ($HgSO_4$), mercurous sulfate ($Hg_2SO_4$), mercury selenide (e.g., $HgSe_2$, $HgSe_8$, HgSe), mercury hydroxides, and organo-mercury compounds (e.g., alkyl mercury compounds) and mixtures of thereof. Mercury can be present in volatile form as well as non-volatile form. In the non-volatile form, mercury can be present in dissolved form, as particles, and/or adsorbed onto particulate surfaces such as quartz, clay minerals, inorganic mineral scale, sand, and asphaltenes.

In one embodiment, crude oil is effectively treated to decrease trace levels of a heavy metal such as mercury. Mercury can be present in crudes in volatile form (e.g., elemental mercury, mercuric chloride, etc.) as well as non-volatile form. In the non-volatile form, mercury can be present in dissolved form, as particles, and/or adsorbed onto the surfaces such as clay minerals, inorganic mineral scale, sand, and asphaltenes. Non-volatile mercury makes up at least 25% of the total mercury in the crude to be treated in one embodiment; at least 50% in a second embodiment; and at least 66% in a third embodiment.

In one embodiment, the non-volatile mercury is converted to volatile form by direct reduction with a reducing agent ("reductant"). In another embodiment, non-volatile mercury in crude oil is converted to elemental mercury $Hg^0$ by treatment by an oxidizing agent ("oxidant") and a reducing agent. After or simultaneously with the conversion of the non-volatile form of mercury to a volatile form, e.g., $Hg^0$, the volatile mercury can be removed by stripping into a gas and optionally followed by adsorption and/or with a scrubber. In another embodiment, the volatile mercury can be removed from the crude oil by adsorption.

Oxidizing Agent ("Oxidant"):

The oxidant can be an organic oxidizing agent, an inorganic oxidant, or a mixture of oxidants. The oxidant can be employed in any form of a powder, slurry, aqueous form, a gas, a material on a support, or combinations thereof.

In one embodiment, the oxidant is selected from the group of halogens, halogen oxides, molecular halogens, peroxides and mixed oxides, including oxyhalites, their acids and salts thereof. In another embodiment, the oxidant is selected from the group of peroxides (including organic peroxides) such as hydrogen peroxide ($H_2O_2$), sodium peroxide, urea peroxide, alkylperoxides, cumene hydroperoxide, t-butyl hydroperoxide, benzoyl peroxide, cyclohexanone peroxide, dicumyl peroxide. In yet another embodiment, the oxidant is selected from the group of inorganic peracids such as Caro's acid ($H_2SO_5$) or salts thereof, organic peracids, such as aliphatic $C_1$- to $C_4$-peracids and, optionally substituted, aromatic percarboxylic acids, peroxo salts, persulfates, peroxoborates, or sulphur peroxo-compounds substituted by fluorine, such as $S_2O_6F_2$, and alkali metal peroxomonosulfate salts. Suitable oxygen-containing oxidizing agents also include other active oxygen-containing compounds, for example ozone. In one embodiment, the oxidant is selected from the group of monopersulfate, alkali salts of peroxide like calcium peroxide, and peroxidases that are capable of oxidizing iodide.

In another embodiment, the oxidizing agent is selected from the group of sodium perborate, potassium perborate, potassium peroxymonosulfate, sodium peroxocarbonate, sodium peroxodicarbonate, and mixtures thereof. In another embodiment, the oxidizing agent is hydrogen peroxide in the form of an aqueous solution containing 1% to 60% hydrogen peroxide (which can be subsequently diluted as needed). In another embodiment, the oxidizing agent is $H_2O_2$ in the form of a stable aqueous solution having a concentration of 16 to 50%. In a third embodiment, the oxidizing agent $H_2O_2$ is used as a solution of 1-3% concentration.

In one embodiment the oxidant selected is a hypochlorite, e.g., sodium hypochlorite, which is commercially produced in significant quantities. The hypochlorite solution in one embodiment is acidic with a pH value of less 4 for at least 80% removal of mercury. In another embodiment, the solution has a pH between 2 and 3. In a third embodiment, the sodium hypochlorite solution has a pH of less than 2. A low pH favors the decomposition to produce $OCl^-$ ions.

In one embodiment, the oxidant is selected from the group of elemental halogens or halogen containing compounds, e.g., chlorine, iodine, fluorine or bromine, alkali metal salts of halogens, e.g., halides, chlorine dioxide, etc. In yet another embodiment, the compound is an iodide of a heavy metal cation. In yet another embodiment, the oxidant is selected from ammonium iodide, an alkaline metal iodide, and etheylenediamine dihydroiodide. In one embodiment, the oxidant is selected from the group of hypochlorite ions ($OCl^-$ such as $NaOCl$, $NaOCl_2$, $NaOCl_3$, $NaOCl_4$, $Ca(OCl)_2$, $NaClO_3$, $NaClO_2$, etc.), vanadium oxytrichloride, Fenton's reagent, hypobromite ions, chlorine dioxine, iodate $IO_3^-$ (such as potassium iodate $KIO_3$ and sodium iodate $NaIO_3$), and mixtures thereof. In one embodiment, the oxidant is selected from $KNnO_4$, $K_2S_2O_8$, $K_2Cr_2O_7$, and $Cl_2$.

In one embodiment, iodine is employed as the oxidizing agent. In this embodiment, the crude oil is first brought into contact with iodine or a compound containing iodine such as alkali metal salts of iodine, e.g., halides or iodide of a cation. In one embodiment, the iodide is selected from ammonium iodide, alkali metal iodide, an alkaline earth metal iodide, and etheylenediamine dihydroiodide.

In one embodiment, the oxidant is selected from the group of DEDCA (diethyl dithiocarbanic acid) in a concentration of 0.1 to 0.5M, DMPS (sodium 2,3-dimercaptopropane-1-sulfonate), DMSA (meso-2,3-dimercaptosuccinic acid), BAL (2,3-dimercapto-propanol), CDTA (1,2-cyclohexylene-dinitrilo-tetraacetic acid), DTPA (diethylene triamine pentaacetic acid), NAC (N-acetyl L-cystiene), sodium 4,5-dihydroxybenzene-1,3-disulfonate, polyaspartates; hydroxyaminocarboxylic acid (HACA); hydroxyethyliminodiacetic (HEIDA); iminodisuccinic acid (IDS); nitrilotriacetic acid (NTA), aminopolycarboxylic acids (such as ethylenediaminetetraacetic acid or EDTA), amino carboxylic acids (ethylenediaminotetraacetate, diethylenetriaminopentaacetate, nitriloacetate, hydroxyethylethylenediaminotriacetate), oxycarboxylic acids (citrate, tartrate, gluconate), and other carboxylic acids and their salt forms, phosphonates, acrylates, and acrylamides, and mixtures thereof.

Reducing Agent ("Reductant"):

In one embodiment after the addition of the oxidant, the crude oil is brought into contact with at least a reducing agent. In another embodiment, the crude oil is brought into contact directly with a reducing agent without any oxidant addition.

Examples of reducing agent include but are not limited to reduced sulfur compounds containing at least one sulfur atom having an oxidation state of less than +6 (e.g., sodium thiosulfate, sodium or potassium bisulfite, ammonium sulfite, metabisulfites, sodium sulfite $Na_2SO_3$, potassium sulfite); ferrous compounds including inorganic and organic ferrous compounds; stannous compounds including inorganic stannous compounds and organic stannous compounds; oxalates which include oxalic acid ($H_2C_2O_4$), inorganic oxalates and organic oxalates; cuprous compounds including inorganic and organic cuprous compounds; organic acids which decompose to form $CO_2$ and/or $H_2$ upon heating and act as reducing agents; nitrogen compounds including hydroxylamine compounds and hydrazine; sodium borohydride ($NaBH_4$); diisobutylaluminium hydride (DIBAL-H); thiourea; a transition metal halide such as cuprous chloride, zinc chloride, nickel chloride; $SO_2$ in $N_2$ or other inert gases, hydrogen; hydrogen sulfide; and hydrocarbons such as $CO_2$ and carbon monoxide.

In one embodiment, the reducing agent is selected from the group of inorganic ferrous compounds including but not limited to iron in the +2 oxidation state and inorganic ligands, e.g., Fe(II) chloride, Fe(II) oxide, ferrous sulfates, ferrous carbonates, and potassium ferrocyanide. In another embodiment, the reducing agent is selected from organic ferrous compounds including but not limited to iron in the +2 oxidation state and carbon-containing ligands, e.g., ferrocene.

In one embodiment, the reducing agent is selected from the group selected from inorganic stannous compounds, including but not limited to tin in the +2 oxidation state and inorganic ligands. Examples are stannous chloride $SnCl_2$ and stannous sulfate. In another embodiment, the reducing agent is selected from organic stannous compounds include tin in the +2 oxidation state and carbon-containing ligands, e.g., tin (II) ethylhexanoate In one embodiment, the reducing agent is selected from the group of inorganic oxalates such as ferrous oxalate, sodium oxalate, and half acid oxalates. In another embodiment, the reducing agent is an organic oxalate of the formula $RR'C_2O_4$ where R is an alkyl or aryl group and R' is hydrogen, an alkyl or aryl group. In another embodiment, the reductant is an organic acid selected from the group of formic acid, ascorbic acid, salicylic acid, tartaric acid, apidic acid. In yet another embodiment, the reductant is selected from the group of inorganic cuprous compounds. Examples are cuprous chloride CuCl and cuprous sulfate $Cu_2SO_4$.

The reducing agent in solution in one embodiment is basic with a pH of at least 7 for a mercury removal of at least 80% in one embodiment; a pH of at least 9 in a second embodiment; and a pH of at least 10 in a third embodiment. The amount of water addition to the reducing agent is less than 90 wt % relative to the crude oil to be treated in one embodiment, less than 50 wt. % relative to the crude oil to be treated in another embodiment; less than 30 wt. % in a third embodiment; and at least 5 wt. % in a fourth embodiment.

Optional Reagent Treatments:

In one embodiment, at least a demulsifier is added to the mixture to facilitate the separation of the crude oil from the heavy metal compounds in the water phase. The demulsifier is added at a concentration from 1 to 5,000 ppm in one embodiment; from 10 to 1,500 ppm in a second embodiment; and in a third embodiment, the demulsifier is added along with pH adjustment by caustic or acid depending on the selected demulsifier. In addition to the demulsifier treatments, surfactants are sometimes added for resolution of solids, viscous oil-water interfaces and sludging if any. The demulsifier can be added directly to the mixture, or in a diluent such as an aromatic hydrocarbon, water or other solvent.

In one embodiment, the demulsifier is selected from the group of polyamines, polyamidoamines, polyimines, condensates of o-toluidine and formaldehyde, quaternary ammonium compounds and ionic surfactants. In another embodiment, the demulsifier is selected from the group of polyoxyethylene alkyl phenols, their sulphonates and sodium sulphonates thereof. In another embodiment, the demulsifier is a polynuclear, aromatic sulfonic acid additive. In yet another embodiment, the demulsifier is selected from the list of polyalkoxylate block copolymers and ester derivatives; alkylphenol-aldehyde resin alkoxylates; polyalkoxylates of polyols or glycidyl ethers; polyamine polyalkoxylates and related cationic polymers; polyurethanes (carbamates) and polyalkoxylate derivatives; hyperbranched polymers; vinyl polymers; polysilicones; and mixtures thereof.

In one embodiment, in addition to or in place of demulsifiers, various polymers commonly used in the art for water treatment can be optionally added. Examples include but are not limited to anionic polyacrylamides, cationic polyacrylamides, polydialkyldiallylammonium salts, alkylamine-epichlorohydrin compounds and combinations thereof.

Methods for Removing Mercury by Converting to Volatile Form—Addition of Oxidant/Reductant for Conversion to Volatile Mercury:

In one embodiment, the crude oil is first brought into contact with an oxidant and optional reagents (e.g., demulsifiers), then a reductant is subsequently added for at least a portion the mercury being converted from a non-volatile to a volatile form. In another embodiment, the crude oil is mixed directly with a reductant and optional reagents, with no oxidant is added.

The temperature of the crude during the addition of the oxidant and/or reductant is at 200° C. or less in one embodiment; less than 100° C. in a second embodiment; at ambient in a third embodiment; and at a temperature of at least 50° C. in a fourth embodiment. After mixing with the additive, e.g., oxidant and reductant, or directly with a reductant, at least 25% of the non-volatile mercury portion of mercury in a crude is converted to a volatile (strippable) form in one embodiment; at least 50% in a second embodiment; at least 75% in a third embodiment; and at least 90% in a fourth embodiment.

If an oxidant is added to the crude oil, the time interval between the addition of the oxidant and reductant is less than 10 hours in one embodiment; less than 1 hour in a second embodiment; less than 15 minutes in a third embodiment; less than 5 minutes in a fourth embodiment; and simultaneous mixing/addition in yet another embodiment.

The oxidant/reductant can be introduced continuously, e.g., in a water stream being brought into contact continuously with a crude oil stream, or intermittently, e.g., injection of a water stream batch-wise into operating gas or fluid pipelines. Alternatively, batch introduction is effective for offline pipelines.

The amount of additive, e.g., oxidizing agent and/or reducing agent needed is determined by the effectiveness of the agents employed. The amount used is at least equal to the amount of mercury in the crude on a molar basis (1:1), if not in an excess amount. In one embodiment, the molar ratio ranges from 5:1 to 50:1. In another embodiment, from 10:1 to 25:1. In yet another embodiment, a molar ratio of additive to mercury ranging from 1.5:1 to 1000:1. In one embodiment for contact with both an oxidant and a reductant, the combined amount of oxidant and reductant is kept at less than 1 mole/bbl of crude. In another embodiment, the level is less than 0.5 mole of combined oxidant and reductant per barrel of crude. In one embodiment, the reducing agent is added to the crude oil in an amount of 0.01 to 10 wt. % based on total weight of crude oil feed, for example 0.02 to 1 wt %, or 0.05 to 0.2 wt %.

In one embodiment, the additive (oxidizing agent and/or reducing agent) is added to the crude oil in an aqueous form, at a volume ratio of water containing oxidant(s)/reductant(s) to crude oil ranges from 0.05:1 to 5:1 in one embodiment; from 1:1 to 2:1 in a second embodiment; from 0.1:1 to 1:1 in a third embodiment; and at least 0.5:1 in a fourth embodiment. The pH of the water stream or treatment solution containing the additive is adjusted to a pre-selected pH prior to addition to the crude oil to less than 6 in one embodiment; less than 5.5 in a second embodiment; less than 4 in a third embodiment; and less than 3 in a fourth embodiment.

After the conversion of the non-volatile mercury to a volatile form, the crude oil in one embodiment is sent to a vessel to separate the treated crude into a gas stream containing most of the volatile mercury and a liquid stream with a reduced concentration of volatile as well non-volatile mercury. The reduced mercury concentration is less than 50% of the mercury originally in the crude in one embodiment, less than 25% of the original concentration in a second embodiment; less than 10% in a third embodiment; less than 5% in a fourth.

The contact (mixing) between the crude oil and the additive (e.g., oxidant, reductant, optional demulsifier, dispersant, etc.) can be either via a non-dispersive or dispersive method. The contact is for at least 30 seconds in one embodiment; at least 1 hr. in a second embodiment; at least 4 hrs. in a third embodiment; at least 12 hours in a fourth embodiment; at least 18 hours in a fifth embodiment; and less than 5 minutes in a sixth embodiment.

The dispersive contacting method can be via mixing valves, static mixers or mixing tanks or vessels. In one embodiment, the non-dispersive method is via either packed inert particle beds or fiber film contactors. In one embodiment, the conversion to volatile mercury is carried out in an integrated unit, e.g., a single vessel having a contact zone for crude containing heavy metals to be in intimate contact with the additive, and a settling zone for the separation of the treated crude (with volatile mercury) from water phase. The additive can be mixed with the crude oil prior to entering the contact zone, or injected as a separate stream into the contacting zone. The flow of the additive and the crude oil in the unit can be counter-current or concurrent.

In one embodiment, the conversion to volatile mercury is via a single tower with a top section for the mixing of the crude oil with the additive and a bottom section for the separation of the treated crude from the water phase. In one embodiment, the top section comprises at least a contactor characterized by large surface areas, e.g., a plurality of fibers or bundles of fibers, allowing mass transfer in a non-dispersive manner. The fibers for use in the contactors are constructed from materials consisting of but not limited to metals, glass, polymers, graphite, and carbon, which allow for the wetting of the fibers and which would not contaminate the process or be quickly corroded in the process. The fibers can be porous or non-porous, or a mixture of both. The fibers are constructed from materials consisting of but not limited to metals, glass, polymers, graphite, and carbon, which allow for the wetting of the fibers and which would not contaminate the process or be quickly corroded in the process. The fibers can be porous or non-porous, or a mixture of both.

In one embodiment, the equipment contains at least two contactors comprising fibers in series. The fibers in each contactor are wetted by the additive to form a thin film on the surface of fibers, and present a large surface area to the crude oil to be in contact with the same or different additive (e.g., reductant). In one embodiment, the admixture of the treated crude oil and the additive exits the bottom of the first contactor and flows into the next contactor in series, wherein additional additive is introduced. The admixture exits the bottom contactor and is directed to a bottom separation section. In one embodiment with at least two contactors in series, the additive feed can be split and added to any of the contactors in series. In another embodiment, crude feed may be split with additional crude being injected into any of the contactors in series for enhanced surface contact between the crude and the additive, with the additive flows through the fibers from one contactor to the next one in series.

In the water-oil separation section, the treated crude is allowed to separate from the aqueous phase via gravity settling. In one embodiment, the bottom section also comprises fibers to aid with the separation, wherein the mixture of treated crude oil and the aqueous phase flows through the fibers to form two distinct liquid layers, an upper layer of treated crude with volatile mercury and a lower aqueous phase layer.

Further details regarding the description of exemplary treatment units are described in US Patent Publication Nos. US20100200477, US20100320124, US20110163008, US20100122950, and US20110142747; and U.S. Pat. Nos. 7,326,333 and 7,381,309, and the relevant disclosures are included herein by reference.

Stripping of Volatile Mercury:

In one embodiment, volatile mercury is stripped from the crude oil while it is in contact with the oxidant and/or reductant. In another embodiment after the conversion of non-volatile mercury to volatile strippable mercury upon contact with an oxidant and/or reductant, the mercury is removed from the treated crude using methods and equipment known in the art, e.g., a stripping unit, an adsorption bed, etc.

In one embodiment, the crude oil is sent to a stripping unit with the addition of a stripping (carrier) gas for the removal of the volatile mercury from the crude into the stripping gas. The crude removed from the bottom of the unit in one embodiment contains less than 50% of the mercury originally in the crude (both volatile and non-volatile forms) in one embodiment.

In one embodiment, the mercury stripper may be as disclosed in U.S. Pat. Nos. 4,962,276 and 7,968,063, the disclosures of which are herein incorporated by reference in its entirety. The stripper can operate in counter current or co-current mode, e.g., in counter current flow with liquid flowing down and gas flowing up, wherein the stripping gas which includes the volatile mercury is withdrawn from the top of the stripper Examples of a stripping gas include but are not limited to air, $N_2$, $CO_2$, $H_2$, methane, argon, helium, steam, air, natural gas, and combinations thereof. In one embodiment, the stripping gas is a gas that originally contained mercury, but from which the mercury has been removed by an Hg adsorbent. In this fashion, a gas can be recycled between the treated crude and an Hg adsorbent, with mercury in the crude being transferred to the adsorbent.

The stripping operation is conducted at a temperature of less than 200° C. in one embodiment; less than 150° C. in a second embodiment; and less than 80° C. in a third embodiment. Upon mercury removal, the vapor can be condensed to recover the light hydrocarbons. The amount of gas used to strip the volatile mercury from the treated crude ranges between 0.01 and 1000 standard volumes of gas per volume of crude per minute in one embodiment; between 0.1 and 100 in a second embodiment; and between 1 and 50 in a third embodiment.

For a stripping operation in batch mode, mercury can be stripped from the treated crude in 0.01-10 hours in one embodiment and between 0.1-1 hour in a second embodiment. For a continuous flow operation, the LHSV of the crude in a stripper ranges between 0.01 and 10 $hr^{-1}$ in one embodiment; and between 0.1 and 1 $hr^{-1}$ in a second embodiment.

After the removal of the mercury in the stripping unit, mercury can be further removed from the crude as well as the stripping gas rich in mercury using methods known in the art, as disclosed in US Patent Application Nos. 2010/0032344, 2010/0032345, and 2005/0167335, and U.S. Pat. Nos. 5,989,506 and 6,367,555, the disclosures of which are incorporated herein by reference in their entirety.

Hg Adsorber:

In one embodiment, a mercury adsorber is used to remove mercury from the stripping gas after the stripper unit, wherein the stripping gas rich in volatile mercury is sent to a fixed bed comprising a mercury adsorbent material. In another embodiment, a mercury adsorber can be used instead of or in addition to a stripping unit to remove mercury from the treated crude.

The adsorber in one embodiment is a fixed bed of active solid adsorbents, which consist of an active component with or without a support. The active component is present in an amount from 0.01 to 99.9 wt % of the combination of support and active component. The support can be carbon, aluminum, silicon, silica-alumina, molecular sieves, zeolites, and combinations.

The active component in one embodiment is selected from the group of sulfur impregnated carbon, silver, copper oxides, ozone-treated carbon, hydrous ferric oxide, hydrous tungsten oxide, and combinations thereof. The active component can be any of the followings: a halogen (such as chlorine, bromine, or iodine) wherein the halogen can be in the zero valent, positive valent, or negative valent state, and used in conjunction with a support to form a solid; a sulfur compound (e.g., an inorganic or organic sulfide, an inorganic or organic sulfhydride, an inorganic or organic polysulfide, adsorbed hydrogen sulfide, and combinations thereof); a metal (e.g., copper, nickel, zinc, aluminum, silver, gold and combinations), wherein the metal can be in the zero valent state, as a hydroxide, as an oxide, as a sulfide, and combinations thereof); sulfur/carbon; Ag/carbon; $Ag/Al_2O_3$; $CuS/Al_2O_3$; CuS/carbon; $FeS/Al_2O_3$; FeS/carbon.

In one embodiment, the adsorbing material is a spent low-temperature shift (LTS) catalyst. Examples include but are not limited to waste LTS catalyst comprising reduced copper oxide-zinc oxide, and composites of copper and zinc oxides which may include other oxides such as chromium oxide or aluminum oxide. In another embodiment, the adsorbing material is a waste/spent catalyst from a primary reformer operation, comprising primarily of nickel oxide. In yet another embodiment, the LTS catalyst is a spent catalyst previously used in fuel processor associated with a fuel cell, comprising highly dispersed gold on a sulfated zirconia, as disclosed in U.S. Pat. No. 7,375,051. In one embodiment for the removal of mercury from the treated crude, the absorbing material is selected from the group of sulfur impregnated carbon (with adsorption capacity of 4,509 micro gram/gram of adsorbent), silver impregnated molecular sieve, copper oxides/sulfides, ozone-treated carbon surface (for a mercury adsorption capacity of carbon increase by a factor of 134), hydrous ferric oxide (HFO), hydrous tungsten oxide, and combinations thereof.

In another embodiment, the adsorbing material is a layered hydrogen metal sulfide structure having the general formula $A_{2x}M_xSn_{3-x}S_6$, where x is 0.1-0.95, A is selected from the group of $Li^+$, $Na^+$, $K^+$ and $Rb^+$; and M is selected from the group of $Mn^{2+}$, $Mg^{2+}$, $Zn^{2+}$, $Fe^{2+}$, $Co^{2+}$ and $Ni^{2+}$, as disclosed in U.S. Pat. No. 8,070,959, the relevant disclosure is herein incorporated by reference. This is a sorbent is characterized as having excellent affinity for mercury ions. The layered hydrogen metal sulfide adsorbent is employed in an amount sufficient for the removal of mercury, ranging from a molar ratio of sulfide to mercury of 2:1 to 50:1 in one embodiment; and from 5:1 to 25:1 in a second embodiment.

The adsorber is operated at a temperature between ambient and 200° C. in one embodiment; between 30 and 150° C. in a second embodiment; and between 40 and 125° C. in a third embodiment. The residence time in the adsorber ranges between 0.01 and 10 hr in one embodiment; and between 0.1 and 1 hr in a second embodiment.

Hg Scrubber:

In addition to or instead of an adsorber unit, a scrubber can also be used for the mercury removal from the stripping gas. In one embodiment, a sulfide scrubbing solution is used to remove mercury from the stripping gas (unless the stripping gas is air), at a concentration of 0.1 to 65 wt % in one embodiment, and from 10 to 45 wt %. in a second embodiment. Examples include but are not limited to sodium sulfide ($Na_2S$), sodium hydrosulfide (NaSH), ammonium hydrosulfide ($NH_4HS$), sodium polysulfide ($Na_2S_x$), calcium polysulfide, and ammonium polysulfide, and combinations thereof. In one embodiment, the mercury-containing stripping gas is passed through a scrubbing tower where it is scrubbed with a dilute alkali solution of $Na_2S_x$. The tower can be packed with structural packing, although a bubble cup or sieve tray could also be employed.

By either scrubbing or adsorption, a treated gas stream with a reduced mercury content is produced with less than 50% of the mercury originally present in the gas in one embodiment; less than 10% of the mercury originally present in a second embodiment; and less than 5% of the mercury originally present in a third embodiment.

After treatment by any of stripping, adsorption, or scrubbing, the treated crude stream contains less than 200 ppbw in mercury in one embodiment; less than 50 ppbw mercury in another embodiment. In terms of original mercury concentration, the treated crude stream contains less than 50% of the mercury initially present in the crude oil feed in one embodiment, 25% of mercury initially present in the crude oil feed in a second embodiment; less than 10% of mercury initially present in the crude oil feed in a third embodiment; and less than 1% of mercury initially present in the crude oil feed in a fourth embodiment.

In one embodiment after mercury is removed from the stripping gas for a "treated gas stream," the treated gas stream can be brought into contact with a crude stream containing volatile mercury to transfer at least a portion of volatile mercury from the crude stream to the treated gas stream, forming a treated crude stream and a mercury rich gas stream. The mercury rich gas stream can be recycled or routed to a stripping unit as part of feedstock to the stripping unit. For example, a treated gas stream can be charged to a contactor along with the crude oil containing volatile as well non-volatile mercury. In the contactor, at least a portion of the volatile mercury is transferred from the crude oil to the gas stream, thereby forming a mercury rich gas stream and a "treated" crude stream. The mercury rich gas stream can be directed to the adsorber unit/scrubbing unit as part of the feed for further mercury removal.

Applications:

The mercury removal methods and equipment described herein may be placed in the same location of a subterranean hydrocarbon producing well, with the scrubbing/adsorbing units being in the same location of the well, or placed as close as possible to the location of the well. In another embodiment, the method is employed to remove predominantly non-volatile from crude during refinery processing steps that precede distillation. This reduces or eliminates mercury contamination in distilled products. In yet another embodiment, the mercury removal equipment is placed on a floating production, storage and offloading (FPSO) unit.

A FPSO is a floating vessel for the processing of hydrocarbons and for storage of oil. The FPSO unit processes an incoming stream of crude oil, water, gas, and sediment, and produce a shippable crude oil with acceptable vapor pressure and basic sediment & water (BS&W) value. In a FPSO, a mixture of crude, water, gas and sediment from an underground formation is passed through a series of separators, and then finally heated. The tank which does the final heating is held at a temperature and for a time sufficient to meet the crude specifications for volatility and BS&W values. The heated crude is then exchanged with the incoming mixture and then sent to storage tanks Demulsifiers, emulsion breakers, corrosion inhibitors, oxygen scavengers, scale inhibitors, and other chemicals are frequently added to the process to facilitate its operation.

Reference will be made to the figures with block diagrams schematically illustrating different embodiments of a process for making a multi-metallic catalyst with minimal waste/metals in the effluent stream.

FIG. 1 is a block diagram illustrating the removal of mercury from crude oil as practiced on a FPSO. As shown in the figure, the tank used for the final heating is used for the mercury removal. Mixture 1 which contains both elemental mercury ($Hg^0$) and particulate mercury is sent to a separator 10, from which are obtained sediment 12 which contains particulate mercury, water 14 and gas 11. The gas 11 contains elemental mercury. A partially dewatered crude 13 is obtained from the separator 10. This partially dewatered crude oil 13 contains particulate mercury which is predominantly non-volatile. The partially dewatered crude 13 is heated in an exchanger 20 to obtain heat from the treated crude oil obtained later in the process 42, and to form a heated partially dewatered crude oil 21. The heated partially dewatered crude oil is further heated in a second exchanger 30, which uses steam 31 and produces condensate 32. This second exchanger produced a hot partially dewatered crude oil 33.

In one embodiment as shown, a slurry of sodium borohydride in oil 41 is injected into the hot partially dewatered crude oil at ~1 wt %, and the mixture passes to a degasser 40 equipped with suitable metallurgy to handle the crude. In the degasser, the sodium borohydride converts over 50% of the particulate mercury into volatile elemental mercury. In one embodiment, the temperature of the degasser is 90° C. and the residence time of the crude is 1 hour. An additional gas stream containing elemental mercury 11 is recovered from the degasser, and the combined gas stream from is processed in a mercury recovery unit (not shown) which adsorbs the mercury for disposal. Additional water is formed in the degasser 14, which is combined with other water streams and disposed safely by reinjection into an underground formation. A treated crude oil 42 is recovered and used in exchanger 20 to heat the partially dewatered crude. A reduced mercury crude 22 can be obtained that meets vapor specifications for shipment, with a satisfactory BS&W content, and contains less than 100 ppbw mercury.

Although not shown, there can be variations on the embodiment. A plurality of separators can be employed. Water can be added to the degasser to remove the oxalic acid residue. Stripping gas can be added to the degasser to facilitate removal of elemental mercury. The stripping gas can be obtained from gas which has been processed in a mercury removal unit (MRU) to remove elemental mercury. Other agents could be used at other weight percents. Alternatively, the mercury could be removed by an adsorber rather than by stripping. Demulsifiers can also be added to improve the contact between the reducing agent and the mercury.

Figure 2:
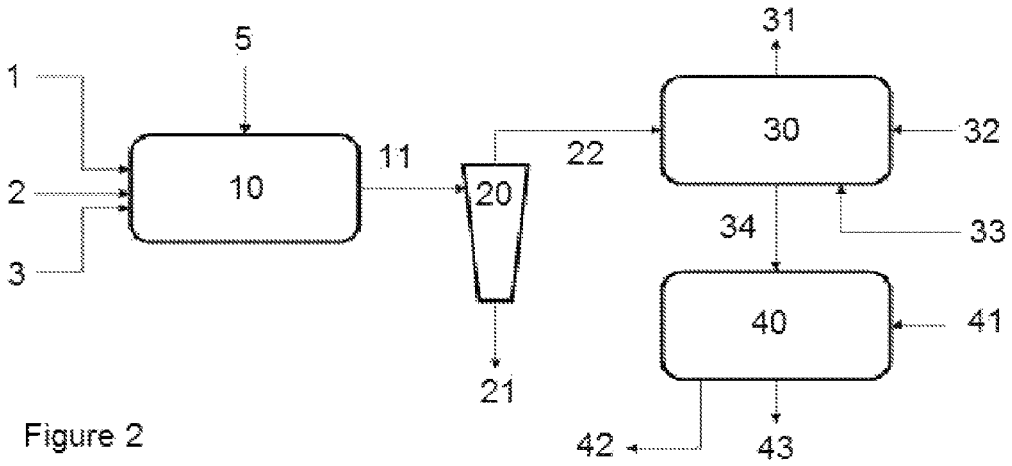
FIG. 2 is another block diagram that illustrates the removal of mercury from other sources, e.g., oily waste streams that are collected on a FPSO.

FIG. 2 is another block diagram that illustrates the removal of mercury from other sources, e.g., oily waste streams that are collected on a FPSO. These waste streams also contain oil that must be recovered, and they contain quantities of particulate mercury. As shown, sump 10 receives at least one stream that contains particulate mercury mixed with crude oil and possibly water. The particulate mercury in this stream is predominantly non-volatile. This stream can be any of pigging waste 1, tank bottoms 2, separator sediments 3 and combinations. Water 5 is added to the sump to form a pumpable mixture 11. This mixture is pumped (by equipment not shown) to a desander/hydrocyclone 20. The desander/hydrocyclone removes the 50 micron and larger size fraction of the particles from the mixture and most of the water as stream 21. A desanded crude 22 is obtained and sent to a treater 30. In one embodiment, the treater operates at 150° C., wherein the crude is in contact with a reductant, e.g., oxalic acid 32 solution and stripping gas 33. In one embodiment, the residence time in the treater is 15 minutes. Reductant oxalic acid is added at 1 wt % relative to the crude and this converts the predominantly non-volatile particulate mercury into volatile mercury. From the stripping unit, stripping gas 31 is produced which contains the volatile mercury. Treated crude 34 is sent to a washer 40, where it is contacted with water 41 to remove unreacted oxalic acid and reaction products. In one embodiment, the washer operates at 60° C. with ~15% water being added relative to the treated crude. Waste water 42 is recovered as well as a reduced mercury crude 43, which 250 ppbw or less mercury.

Although not shown, the stripping gas can be obtained from gas which has been processed in a MRU to remove elemental mercury. Other agents could be used at other weight percents. Alternatively, the mercury could be removed by an adsorber rather than by stripping. The washed and treated crude can be sent to the degasser in embodiment 1 for further removal of mercury. The recovered particles from the desander-hydrocyclone can be disposed by injection into a formation, retorted to recover the elemental mercury, or stored in an appropriate landfill.

Figure 3:
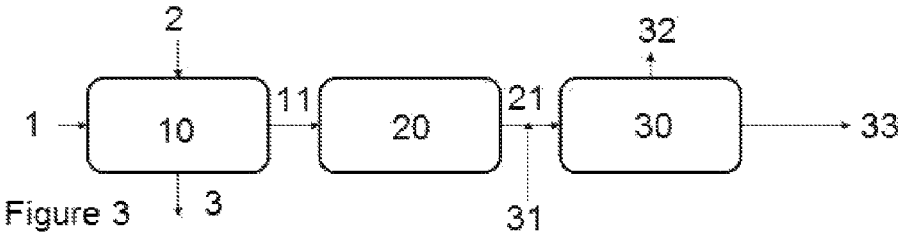
FIG. 3 is a block diagram illustrating the removal of mercury from a crude oil during refinery processing steps that precede distillation.

FIG. 3 is a block diagram illustrating the removal of mercury from a crude oil during refinery processing steps that precede distillation. The crude oil feed contains particulate mercury and is predominantly non-volatile. The removal step reduces or eliminates mercury contamination in distilled products.

As shown, a crude feed 1 which contains mercury in predominantly non-volatile form is introduced to a desalter 10. Water 2 is added along with additives (not shown), forming water stream 3. The desalter acts to remove dissolved salts and sediment from the crude. The sediment will contain a portion of the mercury that was in the crude. The desalted crude 11 is sent to an exchanger 20, which heats the crude by contacting it with hot distilled products from a crude column (not shown). The hot desalted crude 21 is mixed with a reductant, e.g., a tin ethylhexanoate slurry 31 of 1 wt % based on the crude, using mixing means known in the art (not shown). The mixture is sent to a flash vessel 30, which in one embodiment is at 200° C. with a residence time of 15 minutes. A gas is formed which contains elemental mercury 32, and a reduced mercury crude 33 is obtained and sent to the distillation column to obtain reduced mercury distillates (not shown).

Although not shown, a plurality of desalters can be employed. Water can be added to the flash vessel to remove the oxalic acid residue. Stripping gas can be added to the flash vessel to facilitate removal of elemental mercury. The stripping gas can be obtained from gas which has been processed in a MRU to remove elemental mercury. Other agents could be used at other weight percents. Alternatively, the mercury could be removed by an adsorber rather than by stripping.

EXAMPLES

The following examples are given to illustrate the present invention. However, that the invention is not limited to the specific conditions or details described in these examples.

Example 1

In this example, a sample of volatile $Hg^0$ in simulated crude was prepared. First, five grams of elemental mercury $Hg^0$ was placed in an impinger at 100° C. and 0.625 SCF/min of nitrogen gas was passed over through the impinger to form an Hg-saturated nitrogen gas stream. This gas stream was then bubbled through 3123 pounds of Supurla® white oil held at 60-70° C. in an agitated vessel. The operation continued for 55 hours until the mercury level in the white oil reached 500 ppbw by a Lumex™ analyzer. The simulated material was drummed and stored.

Example 2

The Example illustrates the stripping of volatile $Hg^0$ from a crude. First, 75 ml of the simulated crude from Example 1 was placed in a 100 ml graduated cylinder and sparged with 300 ml/min of nitrogen at room temperature. The simulated crude had been stored for an extended period of time, e.g., months or days, and its initial value of mercury had decreased to about 369 ppbw due to vaporization (at time 0). The mercury in this simulated crude was rapidly stripped consistent with the known behavior of $Hg^0$, as shown in Table 1. The effective level of mercury at 60 minutes is essentially 0 as the detection limit of the Lumex™ analyzer is about 50 ppbw.

TABLE 1

| Time, min | Mercury, ppbw |
|---|---|
| 0 | 369 |
| 10 | 274 |
| 20 | 216 |
| 30 | 163 |
| 40 | 99 |
| 50 | 56 |
| 60 | 73 |
| 80 | 44 |
| 100 | 38 |
| 120 | 11 |
| 140 | 25 |
| Pct Volatile Hg | 80 |

Examples 3-5

Various samples of crudes from different sources were obtained, analyzed for particulate mercury using the modified BS&W test, and studied in the stripping test. In contrast to the simulated crude which used $Hg^0$, the mercury in these crudes is predominantly non-volatile and contains Hg particles. Crudes 1 & 2 had pour points above room temperature and were stripped at 60° C. Crude 3 was fluid at room temperature and was stripped at room temperature. Table 2 shows the results of the analyses.

TABLE 2

| Example 3 Crude 1 34% particulate Hg 60° C. | | Example 4 Crude 2 91% particulate Hg 60° C. | | Example 5 Crude 3 76% particulate Hg Ambient | |
|---|---|---|---|---|---|
| Time, min | Hg, ppbw | Time, min | Hg, ppbw | Time, min | Hg, ppbw |
| 0 | 444 | 0 | 6130 | 0 | 3361 |
| 10 | 397 | 10 | 6172 | 10 | 3334 |
| 20 | 407 | 20 | 5879 | 20 | 3329 |
| 30 | 405 | 30 | 6653 | 30 | 3539 |
| 40 | 432 | 40 | 6255 | 40 | 3303 |
| 50 | 427 | 50 | 6886 | 50 | 3710 |
| 60 | 398 | 60 | 6420 | 60 | 3539 |
| 80 | 413 | 80 | 6626 | — | — |
| 100 | 460 | — | — | — | — |
| 120 | 427 | | | | |
| 140 | 427 | — | — | — | — |
| 160 | 419 | — | — | — | — |
| 180 | 481 | — | — | — | — |
| Volatile Hg % | 10 | Volatile Hg % | 0 | Volatile Hg % | 0 |

Examples 6-9

Two additional crude samples, a condensate sample, and a commercially distilled naphtha sample were analyzed for particulates and volatile mercury in a method as described in Bloom, N. S., Analysis and stability of mercury speciation in petroleum hydrocarbons. Fresenius J Anal Chem. 2000, 366 (5) 438-443. Table 3 shows the results of the analyses.

TABLE 3

| | Example 6 Condensate | Example 7 Crude 4 | Example 8 Crude 5 | Example 9 Distilled Naphtha |
|---|---|---|---|---|
| Hg Content, ppbw | 2,761 | 416 | 1,283 | 625 |
| Particulate Hg % | 92 | 52 | 99 | 0 |
| Volatile Hg % | 0.2 | 0.1 | 0.1 | 89 |

The mercury in the condensate and two crude samples was predominantly particulate and was predominantly non-volatile. In contrast, the mercury in the commercially distilled naphtha contained no particulate Hg and was highly volatile. The mercury in this naphtha can be removed by use of an Hg Adsorbent. The properties of the Hg in the distilled naphtha are consistent with the properties of $Hg^0$.

Example 10

A control crude sample was prepared. First, 70 mL of crude oil was placed into a glass reactor with water jacket at 60° C. Mercury level in the oil was measured with Lumex™ Hg analyzer. $N_2$ was sparged rigorously into the oil sample at 30 CFM, and stirring was started at 600 rpm for 4 minutes. The agitator was stopped for 1 minute, followed by sampling for Hg measurement at intervals of 2, 5, 15, and 30 minutes with agitation in between. Results are shown in Table 4. Results indicate that the mercury present in the crude oil sample is predominantly in non-volatile (not removed by the stripping) with relatively constant amount of Hg concentration, although there is a slight increase in Hg concentration due to some stripping of light hydrocarbons.

Example 11

Addition of oxidation agent iodine to the crude oil was illustrated. Example 10 was repeated, with the addition of a pre-determined amount of 1% iodine ($I_2$) prep in Aromatic 150 into the reactor at a molar ratio of Hg to $I_2$ of 20 after the sparging of $N_2$. Stirring was started at 600 rpm for 4 minutes. The agitator was stopped for 1 minute, followed by sampling for Hg measurement at intervals of 1.5, 3, 5, 15, and 30 minutes with agitation in between. Results are shown in Table 4. The increase in Hg concentration over time can be attributed to variability of the measurement and/or removal of some light hydrocarbons by the stripping gas, causing an increase in Hg concentration.

Example 12

Addition of oxidation agent iodine and reductant $NaBH_4$ to the crude oil was illustrated. First, 30 mL of deionized water was placed into a glass reactor with water jacket at 60° C., and Hg level in water was measured. Next, 70 mL crude oil was placed into the glass reactor with water jacket 60° C., and Hg level in crude oil was measured. $N_2$ was sparged rigorously into the oil sample at 30 CFM. A pre-determined amount of 1% iodine ($I_2$) prep in Aromatic 150 fluid was added to the reactor containing the oil sample at the molar ratio of Hg to $I_2$ of 20. Start stirring at 600 rpm for 4 min. Stop the agitator and add a pre-determined amount of 1% $NaBH_4$ prep in DI water into the reactor at the molar ratio of $NaBH_4$ to $I_2$ of 10. Agitator was started again then stopped at 1.5 min for sampling and measurement of Hg in crude oil and water, followed by sampling for Hg measurement at intervals of 3, 5, 15, and 30 min with agitation in between. Results of Hg measurements in water and oil samples taken at various intervals are also shown in Table 4. The results show that approximately 50% of the initial mercury was removed from the crude sample, with a fraction being transferred to the water phase and the remaining mercury was removed as volatile mercury by the stripping gas (with decreased concentration of mercury in the crude).

TABLE 4

| Example 10 Control - no additive | | Example 11 Oxidant $I_2$ | | Example 12 - Oxidant/Reductant WATER | | OIL | |
|---|---|---|---|---|---|---|---|
| minutes | Hg, ppbw | minutes | Hg, ppbw | minutes | Hg, ppbw | minutes | Hg, ppbw |
| Initial oil | 6643 | 0 | 6595 | Initial water | 0 | Initial oil | 6652 |
| 0 | 6643 | 4 min after $I_2$ | 7850 | 0 | 0 | 0 | 5391 |
| 2 | 7001 | 1.5 | 7227 | 1.5 | 183 | 1.5 | 4689 |
| — | — | 3 | 7209 | 3 | 318 | 3 | 3812 |
| 5 | 6440 | 5 | 6440 | 5 | 306 | 5 | 3559 |
| 15 | 6383 | 15 | 7685 | 15 | 671 | 15 | 3198 |
| 30 | 7556 | 30 | 8051 | 30 | — | 30 | 3308 |
| 60 | 7401 | — | — | — | — | — | — |

Examples 13-17

Various reducing agents were tested by putting 8 grams of Crude 3 containing 742 ppbw Hg>50% of the mercury being non-volatile), and 0.1 grams of reducing agent, into a Teflon cup of a 23 cc Parr digestion autoclave. The autoclave was sealed and placed on a rotating spit at 170° C. overnight. In the morning, the autoclave was cooled and then opened. Upon opening the volatile mercury content at the lip of the Teflon cup was measured by use of a Jerome analyzer. The crude oil in the cup was then stripped with 300 cc/min of $N_2$ and the mercury content was measured versus time. Mercury measurements were also made before the start of autoclave experiment and just after the autoclave is opened. Results are summarized in Table 5.

TABLE 5

| | Example | | | | |
|---|---|---|---|---|---|
| | 13 | 14 | 15 | 16 | 17 |
| Agent Used | None | NaBH4 | SnCl2 | $Na_2SO_3$ | Oxalic Acid |
| Volatile Hg at cup mouth, μg/m³ | Not Measured | 141.4 | 586.8 | 5.48 | Not Measured |
| % Hg removal vs stripping time | | | | | |
| Initial | ~0 | 45 | 51 | 15 | 95 |
| 10 min | 20 | 86 | 80 | ~0 | 97 |
| 20 min | 18 | 87 | 84 | ~0 | 97 |
| 30 min | 20 | 88 | 86 | ~0 | 96 |
| 40 min | 9 | 89 | 85 | ~0 | |
| 50 min | 7 | 85 | 84 | ~0 | |
| 60 min | 3 | 92 | 83 | ~0 | |

Examples 18-20

The Examples were to evaluate the effect of temperature and mixing on the conversion process. In these examples, 8 grams of Crude 3 containing 742 ppbw Hg (>50% non-volatile Hg) and 0.1 grams of reducing agent were added to a 23 cc Teflon cup. The cup was heated on hot plate the test temperature, and stripped with 300 cc/min of $N_2$. The mercury content was measured immediately and followed for one hour. In experiments 18 and 19, the cup was equipped with a magnetic stir bar. In experiment 20, the stir bar was not used and only the agitation from the $N_2$ stripping was employed. The results in Table 6 show that the mercury removal is enhanced by operation at temperatures above 25° C. and with mixing. Since the mercury in crudes is in the form of particulates, and the reagents are also solids, mixing is expected to facilitate the reaction.

TABLE 6

| | Example | | |
|---|---|---|---|
| | 18 | 19 | 20 |
| Reducing Agent | Oxalic Acid | Oxalic Acid | Oxalic Acid |
| Temperature, ° C. | 25 | 60 | 60 |
| Stirred? | Yes | Yes | No |
| % Hg removal vs stripping time | | | |
| Initial | | 0 | 13 |
| 10 min | 26 | 56 | 1 |
| 20 min | 19 | 77 | ~0 |
| 30 min | 12 | 81 | ~0 |
| 40 min | | 82 | ~0 |
| 50 min | | 78 | 57 |
| 60 min | | 74 | 69 |

Example 21-24

Different reducing agents were placed in separate glass vials each equipped with a $N_2$ bubbler operating at about 300 ml/min, and placed in a water bath. The bath was held at 60° C. and the water level was maintained by use of a chicken feeder. A Crude 3 sample with a mercury concentration of 1242 ppbw (>50% non-volatile Hg) was used in the experiments. In each glass vial, 20 ml of crude was added and 0.2 grams of reducing agent (~1.2 wt % reducing agent). Results after ~16 hours contact are summarized in Table 7.

TABLE 7

| Experiment No. | Chemical agent | Percent Hg removal |
|---|---|---|
| 21 | Oxalic Acid Dihydrate | 41 |
| 22 | Tin(II) 2-ethylhexanoate | 35 |
| 23 | Stannous Chloride | 19 |
| 24 | Sodium Sulfite | 7 |

Examples 25-27

The Examples were carried out according to the procedures in Examples 21-24 except with different dosages of reducing agents. Results are summarized in Table 8.

TABLE 8

| Examples | Chemical agent | Wt % Agent | % t Hg removal |
|---|---|---|---|
| 25 | Oxalic Acid Dihydrate | 0.6 | 10 |
| 26 | Oxalic Acid Dihydrate | 1.2 | 41 |
| 27 | Oxalic Acid Dihydrate | 6.0 | 62 |

Examples 28-30

In these examples, high mercury crudes from different sources (with >50% non-volatile mercury) were evaluated with oxalic acid as reducing agents according to the procedures in Examples 21-25. Results are shown in Table 9.

TABLE 9

| Examples | Agent | Wt % agent | Initial Hg, ppbw | % Hg removal |
|---|---|---|---|---|
| 28 | Oxalic Acid Dihydrate | 1.2 | 2836 | 64 |
| 29 | Oxalic Acid Dihydrate | 1.2 | 658 | 10 |
| 30 | Oxalic Acid Dihydrate | 1.2 | 5813 | 44 |

Examples 31-36

In these examples, a high mercury crude with 3748 ppbw mercury (>50% non-volatile mercury) was evaluated with different reducing agents at 90° C. according to the procedures in Examples 21-24. The mercury content did not change significantly upon stripping at 90° C. Results shown in Table 10 were obtained after one hour of mixing with reducing agent and after overnight stripping (16 hours).

TABLE 10

| Examples | Agent | % Hg removal at 1 hr. | % Hg removal at 16 hrs. |
|---|---|---|---|
| 31 | None | 4 | ~0 |
| 32 | Oxalic acid dihydrate | 1 | 93 |
| 33 | Tin(II) 2-ethylhexanoate | 25 | 39 |
| 34 | Stannous chloride | ~0 | 28 |
| 35 | Sodium sulfite | 11 | 9 |
| 36 | Sodium borohydride | 18 | 54 |

Examples 37-42

Examples 31-36 were duplicated except for the addition of 2 ml of water to the reducing agent prior to the addition of a high mercury crude (3748 ppbw mercury with >50% non-volatile mercury). The results as shown in Table 11 indicate that water helped dissolve the reducing agents and promote contact with the crude.

TABLE 11

| Examples | Agent | % Hg removal at 1 hr. |
|---|---|---|
| 37 | None | 3 |
| 38 | Oxalic acid dihydrate | 93 |
| 39 | Tin(II) 2-ethylhexanoate | 40 |
| 40 | Stannous chloride | 97 |
| 41 | Sodium sulfite | 6 |
| 42 | Sodium borohydride | 100 |

Examples 43-54

The procedure in Examples 37-42 with 2 ml of water was repeated, but at different dosage level of the reductant for the treatment of a high mercury crude (3748 ppbw mercury with >50% non-volatile mercury). Results are shown in Table 12, showing that some agents are most effective at low concentrations.

TABLE 12

| Examples | Agent | dose rate, wt % relative to crude | % Hg removal at 1 hr. |
|---|---|---|---|
| 43 | Oxalic Acid Dihydrate | 1.2 | 93 |
| 44 | " | 0.6 | 1 |
| 45 | " | 0.3 | ~0 |
| 46 | Stannous Chloride | 1.2 | 97 |
| 47 | " | 0.6 | 42 |
| 48 | " | 0.3 | ~0 |
| 49 | Sodium Borohydride | 1.2 | 100 |
| 50 | " | 0.6 | 99 |
| 51 | " | 0.3 | 70 |
| 52 | " | 0.3 | 83 |
| 53 | " | 0.12 | 17 |
| 54 | " | 0.06 | 2 |

Examples 55-62

Some reductants, e.g., sodium borohydride, are known to decompose in water to form molecular hydrogen. This decomposition increases as the concentration of the reductant increases and as the pH drops. In these examples, the impact of water amount, relative to crude, was studied along with the addition of a small amount of either 1% sodium hydroxide or 1% sulfuric acid solutions. The crude is a high mercury, predominantly non-volatile crude containing 1304 ppbw mercury, with 0.02 grams of sodium borohydride added to 20 ml of crude oil for a concentration of 0.12 wt %. After stripping at 90° C. for one hour in the absence of the reduction agent, the mercury content increased to 1414 ppbw due to the evaporation of light ends. This demonstrates that the mercury in this material is substantially non-volatile. The results are shown in Table 15, with the percent mercury removed is based on the 1414 ppbw value after striping. The results show that: a) sodium borohydride to be highly effective even when used at 0.12 wt % treating rate; b) the effectiveness of a reductant such as sodium borohydride is greatest when the water content relative to crude is relatively low; and c) mercury treatment is more effect under basic conditions, e.g., pH of greater 7.

TABLE 13

| Example | wt. % water relative to crude | 1% NaOH solution, vol % relative to crude | 1% $H_2SO_4$ solution, vol % relative to crude | % Hg removal at 1 hr. |
|---|---|---|---|---|
| 55 | 10 | 0 | 0 | 17 |
| 56 | 10 | 0 | 0 | 82 |
| 57 | 20 | 0 | 0 | 67 |
| 58 | 5 | 0 | 0 | 79 |
| 59 | 10 | 0 | 0.5 | 67 |
| 60 | 10 | 0.5 | 0 | 81 |
| 61 | 5 | 0 | 0.25 | 83 |
| 62 | 5 | 0.25 | 0 | 87 |

Examples 63-69

Examples 55-62 were repeated with a reduced treating rate of sodium borohydride to 0.06 wt %. The results in Table 14 confirms favorable results with the addition of a basic reagent and with a low concentration of water.

TABLE 14

| Example | wt. % water relative to crude | 1% NaOH solution, vol % relative to crude | 1% $H_2SO_4$ solution, vol % relative to crude | % Hg removal at 1 hr. |
|---|---|---|---|---|
| 63 | 10 | 0 | 0 | ~0 |
| 64 | 20 | 0 | 0 | 3 |
| 65 | 5 | 0 | 0 | 1 |
| 66 | 10 | 0 | 0.5 | 8 |
| 67 | 10 | 0.5 | 0 | 49 |
| 68 | 5 | 0 | 0.25 | 24 |
| 69 | 5 | 0.25 | 0 | 55 |

Examples 70-71

Two experiments were conducted with the crude used in Examples 55-62 (crude with 1304 ppbw mercury) at 90° C. for one hour. In these studies, solid and liquid reduction agents were not added. Instead the nitrogen used in the experiments was replaced with hydrogen gas. In experiment 70, no water was added to the crude and only 1 wt. % mercury was removed. In experiment 71, 10 vol. % water was added and 12 w % mercury was removed. In neither experiment was an effective amount of mercury removed.

Example 72

In this example, 180 ml of Crude 3 was tested with 20 ml of 10% sodium borohydride solution (for 10 vol. % sodium borohydride, effectively a 1% treat rate on crude). The reaction was performed in a sealed gas reactor that was purged with 300 ml/min of nitrogen. The nitrogen exiting the glass reactor was passed through a solution of 10% sodium polysulfide to capture the elemental mercury formed by the reduction of the particulate mercury. The temperature was 77° C. Samples were withdrawn at 1 min and at various times for 1 hour. After one hour, the nitrogen flow was stopped and the mixture allowed to separate for 1 hour at 77° C. The reaction was very rapid with over 50% of the mercury being removed in one minute. This led to almost complete removal of Hg from both the oil and water phases. The sodium polysulfide solution picked up most of the mercury, but some still appears as "lost" either to emulsion, $Hg^0$ that escaped the trap, adsorbed on the walls or tubing, or errors in the initial Hg measurement. Table 14 shows the material balance at start and end of the experiment.

TABLE 15

| | Volume, ml | Weight, g | Intial ppb Hg | Initial µg, Hg | Final ppb Hg | Final µg, Hg | % of initial |
|---|---|---|---|---|---|---|---|
| Crude Oil | 180 | 153 | 1289 | 197 | 116 | 18 | 9.0 |
| Water phase | 20 | 20 | 0 | 0 | 0 | 0 | 0.0 |
| Na2Sx 10% | 150 | 165 | 0 | 0 | 863 | 142 | 72.2 |
| Sum | — | — | — | 197 | — | 160 | 81.2 |
| Loss | — | — | — | — | — | 37 | 18.8 |

Example 73

Example 72 was repeated but with deionized water. Table 15 shows the material balance at start and end of the control experiment. This experiment, compared with the previous one, demonstrates that a reducing agent is needed to convert the mercury into a volatile form.

TABLE 16

| | Volume, ml | Weight, g | Initial ppb Hg | Initial µg, Hg | Final ppb Hg | Final µg, Hg | % of initial |
|---|---|---|---|---|---|---|---|
| Crude Oil | 180 | 153 | 1366 | 209 | 791 | 121 | 57.9 |
| Water phase | 20 | 20 | 0 | 0 | 13 | 0 | 0.1 |
| Na2Sx 10% | 150 | 165 | 0 | 0 | 0 | 0 | 0.0 |
| Sum | — | — | — | 209 | — | 121 | 58.0 |
| Loss | — | — | — | | — | 88 | 42.0 |

Examples 74-83

A number of examples were conducted to evaluate the addition of demulsifiers in the transfer of species across the crude-water interface. The demulsifiers were commercially available from a number of companies including Nalco Energy of Sugarland, Tex.; Multi-Chem, Baker-Hughes and Champion Technologies all of Houston, Tex. Experiments 31-36 were repeated with a crude containing 1177 ppbw mercury of which over 50% was particulate mercury. In each example, 20 ml of crude were added to glass vials and 2 ml of 10% sodium borohydride ($NaBH_4$) solution was added, followed by the addition of 5 µL of a demulsifier as listed. The vial was then heated to 90° C. and bubbled with flowing $N_2$ for one hour, then the mercury content of the treated crude was evaluated. The base point with no demulsifier and no sodium borohydride showed a value of 871 ppbw mercury, likely due to sampling differences between the initial and final samples. The results are shown in Table 17.

TABLE 17

| Example | Demulsifier | $NaBH_4$ wt % to crude | ppbw Hg | % mercury removed relative to base |
|---|---|---|---|---|
| 74 | None | None | 871 | Base |
| 75 | None | 1 wt % | 256 | 71 |
| 76 | EC2460A from Nalco | 1 wt % | 85 | 90 |
| 77 | Tretolite DMO83409 from Baker-Hughes | 1 wt % | 31 | 96 |
| 78 | PX0191 from Nalco | 1 wt % | 394 | 55 |
| 79 | EC2217 from Nalco | 1 wt % | 207 | 76 |
| 89 | MXI-1928 from Multi-chem | 1 wt % | 153 | 82 |
| 81 | FX2134 from Nalco | 1 wt % | 118 | 86 |
| 82 | RIMI-84A from Champion Technologies | 1 wt % | 164 | 81 |
| 83 | MXI-2476 from Multichem | 1 wt % | 235 | 73 |

Examples 84-93

Examples 74-83 were repeated in the absence of sodium borohydride to confirm that the use of demulsifiers removed very little mercury, if any. The results are shown in Table 18:

TABLE 18

| Example | Demulsifier | $NaBH_4$ wt % to crude | ppbw Hg | % mercury removed relative to base |
|---|---|---|---|---|
| 84 | None | None | 1,428 | Base |
| 85 | None | 1 wt % | 378 | 73 |
| 86 | EC2460A from Nalco | None | 1,434 | 0 |
| 87 | Tretolite DMO83409 from Baker-Hughes | None | 1,168 | 18 |
| 88 | PX0191 from Nalco | None | 1,201 | 16 |
| 89 | EC2217 from Nalco | None | 1,462 | 2 |
| 90 | MXI-1928 from Multi-chem | None | 1,551 | 0 |
| 91 | FX2134 from Nalco | None | 1,022 | 28 |
| 92 | RIMI-84A from Champion Technologies | None | 1,424 | 0 |
| 93 | MXI-2476 from Multichem | None | 1,530 | 0 |

Examples 94-98

Additional Examples were carried out to confirm maximum mercury removal with the use of demulsifiers in conjunction with a reducing agent. The experiments were performed using 20 ml of a crude sample having that contained 1308 ppbw mercury. To the crude sample with bubbling nitrogen gas, 5 μL of Tretoline DMO83409 from Baker-Hughes of Houston, Tex., and 2 ml of 10% reductant dissolved in deionized water were added. Samples were heated to 90° C. for one hour, and then the mercury level of the treated crude sample was removed. The results are shown in Table 19.

TABLE 19

| Example | Reductant | Hg content, ppbw | % mercury removed |
|---|---|---|---|
| 94 | Ferrous Sulfate | 1056 | 19 |
| 95 | Sodium Sulfite | 923 | 29 |
| 96 | Ammonium Sulfite | 609 | 53 |
| 97 | Sodium Bisulfite | 752 | 42 |
| 98 | Potassium Ferrocyanide | 763 | 42 |

Examples 99-105

A number of examples were conducted to evaluate the addition of water treating chemicals from Tramfloc (Tempe, Ariz.) in the transfer of species across the crude-water interface. Experiments 74-73 were repeated with a crude containing 453 ppbw mercury (>over 25% was particulate mercury and with insignificant amount of volatile mercury). In each example, 20 ml of crude were added to glass vials, followed by 2 ml of 10% sodium borohydride ($NaBH_4$) solution and 5 μL of a chemical as listed. The vial was then heated to 90° C. and bubbled with flowing $N_2$ for one hour, then the mercury content of the treated crude was evaluated. The base point with no demulsifier and no sodium borohydride showed a value of 444 ppbw mercury, likely due to sampling differences between the initial and final samples. The results are presented in Table 20, showing that the addition of water treating chemicals facilitated the removal of mercury.

TABLE 20

| Example | Chemical | Hg ppbw | % mercury removed |
|---|---|---|---|
| 99 | None - $NaBH_4$ alone | 232 | 48 |
| 100 | TRAMFLOC 141 an anionic polyacrylamide emulsion | 203 | 54 |
| 101 | TRAMFLOC 300 a cationic polyacrylamide emulsion | 159 | 64 |
| 102 | TRAMFLOC 304 a cationic polyacrylamide emulsion | 159 | 64 |
| 103 | TRAMFLOC 308 a cationic polyacrylamide emulsion | 146 | 67 |
| 104 | TRAMFLOC 330 a cationic polyacrylamide emulsion | 147 | 67 |
| 105 | TRAMFLOC 860A alkylamine-epichlorohydrin in water | 192 | 57 |

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

As used herein, the term "include" and its grammatical variants are intended to be non-limiting, such that recitation of items in a list is not to the exclusion of other like items that can be substituted or added to the listed items. The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms, including technical and scientific terms used in the description, have the same meaning as commonly understood by one of ordinary skill in the art to which this invention belongs.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A method for reducing a trace amount of mercury in a crude oil feed, comprising:

providing a crude oil feed having a first concentration of non-volatile mercury, mixing an effective amount of a reducing agent with the crude oil feed to convert at least a portion of the non-volatile mercury into a volatile mercury;

removing at least a portion of the volatile mercury by at least one of stripping, scrubbing, adsorption, and combinations thereof to obtain a crude oil having a reduced concentration of mercury;

wherein the reducing agent is selected from sulfur compounds containing at least one sulfur atom having an oxidation state less than +6; ferrous compounds; stannous compounds; oxalates; cuprous compounds; organic acids which decompose to form $CO_2$ upon heating; hydroxylamine compounds; hydrazine compounds; sodium borohydride; diisobutylaluminium hydride; thiourea; transition metal halides; sulfites, bisulfites and metabisulfites; and mixtures thereof.

2. The method of claim 1, wherein the reducing agent is selected from oxalic acid, cuprous chloride, stannous chloride, sodium borohydride, and mixtures thereof.

3. The method of claim 2, wherein the reducing agent is sodium borohydride.

4. The method of claim 1, wherein the reducing agent is mixed with the crude oil feed at a temperature of at least 50° C.

5. The method of claim 1, wherein the reducing agent is mixed with the crude oil feed for at least 30 seconds.

6. The method of claim 1, wherein the reducing agent is in aqueous solution for a concentration of less than 10 wt. % relative of crude oil feed.

7. The method of claim 1, further comprising adding a sufficient amount of a base for the mixture of crude oil feed and reducing agent to have a pH of at least 7.

8. The method of claim 1, wherein the crude oil feed has a first concentration of non-volatile mercury of at least 100 ppbw.

9. The method of claim 1, wherein the non-volatile mercury comprises at least 25% of total mercury present in the crude oil feed.

10. The method of claim 9, wherein the non-volatile mercury comprises at least 50% of total mercury present in the crude oil feed.

11. The method of claim 1, wherein an effective amount of a reducing agent is mixed into the crude oil to convert at least 50% of the non-volatile mercury to volatile mercury.

12. The method of claim 1, wherein an effective amount of a reducing agent is mixed into the crude oil to convert at least 90% of the non-volatile mercury to volatile mercury.

13. The method of claim 1, wherein an effective amount of a reducing agent is added in an amount of 0.01 to 10 wt % based on total crude oil feed.

14. The method of claim 13, wherein an effective amount of a reducing agent is added in an amount of 0.02 to 1 wt % based on total crude oil feed.

15. The method of claim 1, wherein the volatile mercury is removed from the crude oil by stripping in a stripping unit with a stripping gas selected from air, $N_2$, $CO_2$, $H_2$, methane, argon, helium, steam, natural gas, and combinations thereof, to obtain a gas stream containing mercury and a crude stream having a reduced concentration of non-volatile mercury.

16. The method of claim 1, wherein the volatile mercury is removed from the crude oil by adsorption in a fixed bed containing a layered hydrogen metal sulfide material having a formula $A_{2x}M_xSn_{3-x}S_6$, where x is 0.1-0.95, A is selected from the group of $Li^+$, $Na^+$, $K^+$ and $Rb^+$; and M is selected from the group of $Mn^{2+}$, $Mg^{2+}$, $Zn^{2+}$, $Fe^{2+}$, $Co^{2+}$ and $Ni^{2+}$.

17. The method of claim 1, wherein the volatile mercury is removed from the crude oil by adsorption in a fixed bed containing an active component selected from the group of sulfur impregnated carbon, ozone-treated carbon, hydrous ferric oxide, copper, nickel, zinc, aluminum, silver, gold, and combinations thereof.

18. The method of claim 1, wherein the volatile mercury is removed from the crude oil by adsorption in a fixed bed containing a spent low-temperature shift catalyst.

19. The method of claim 18, wherein the spent low temperature waste catalyst is selected from copper oxide, zinc oxide, chromium oxide, aluminum oxide, and composites thereof.

20. The method of claim 15, further comprising:

removing mercury from the gas stream to provide a treated gas stream;

contacting the treated gas stream with the crude stream to transfer at least a portion of volatile mercury from the liquid hydrocarbon stream to the treated gas stream and thereby form a treated crude stream and a mercury rich gas stream; and passing the mercury rich gas stream to the stripping unit as part of feedstock to the stripping unit.

21. The method of claim 20, wherein mercury is removed from the mercury rich gas stream in an adsorber having a fixed bed containing a layered hydrogen metal sulfide material having a formula $A_{2x}M_xSn_{3-x}S_6$, where x is 0.1-0.95, A is selected from the group of $Li^+$, $Na^+$, $K^+$ and $Rb^+$; and M is selected from the group of $Mn^{2+}$, $Mg^{2+}$, $Zn^{2+}$, $Fe^{2+}$, $Co^{2+}$ and $Ni^{2+}$.

22. The method of claim 20, wherein mercury is removed from the mercury rich gas stream in a fixed bed comprising a mercury adsorbent material selected from the group of sulfur impregnated carbon, silver, copper oxides, ozone-treated carbon, hydrous ferric oxide, hydrous tungsten oxide, zinc oxide, nickel oxide, a spent low-temperature shift catalyst, and combinations thereof.

23. The method of claim 22, wherein the mercury adsorbent material is a spent low temperature waste catalyst selected from copper oxide, zinc oxide, chromium oxide, aluminum oxide, and composites thereof.

24. The method of claim 20, wherein mercury is removed from the mercury rich gas stream in a scrubbing system wherein the gas stream is passed scrubbed with an alkali solution of $Na_2S_x$.

25. The method of claim 20, wherein the treated crude stream contains less than 100 ppbw in mercury.

26. The method of claim 20, wherein the treated crude stream contains less than 50% of mercury initially present in the crude oil feed.

27. In an improved process to removal mercury from a crude oil stream containing mercury, the process comprising: a) providing a crude oil stream containing mercury from a crude oil well; b) separating the crude oil stream into a gaseous hydrocarbon stream comprising hydrocarbons, mercury and water, and a liquid hydrocarbon stream comprising hydrocarbons and elemental mercury; c) charging a mercury-containing gas feed, including in part at least a portion of the gaseous hydrocarbon stream, to a mercury removal unit for removal of mercury from mercury-containing gas feed, thereby forming a treated gas stream; d) contacting a recycle gas stream comprising a portion of the treated gas stream with at least a portion of the liquid hydrocarbon stream for transfer of at least a portion of the elemental mercury contained in the liquid hydrocarbon stream to the recycle gas stream; thereby forming a mercury rich gas stream, and a treated liquid hydrocarbon stream; and e) passing said mercury rich gas stream to the mercury removal unit as a portion of the mercury-containing gas feed, wherein the improvement comprises:

mixing an effective amount of a reducing agent with the crude oil stream to convert at least a portion of the mercury into a volatile mercury;

wherein the mixing into the crude oil stream is prior to separating the crude oil stream into a gaseous hydrocarbon stream and a liquid hydrocarbon stream.

28. In an improved process to removal mercury from a crude oil stream containing mercury, the process comprising: a) separating the crude oil stream into a gaseous hydrocarbon stream and a liquid hydrocarbon stream; b) removing mercury from the gaseous hydrocarbon stream to provide a treated gas stream; c) contacting the treated gas stream with the liquid hydrocarbon stream to transfer mercury from the liquid hydrocarbon stream to the treated gas stream and thereby form a treated liquid stream and a mercury rich gas stream; and d) removing mercury from the mercury rich gas stream, wherein the improvement comprises:

mixing into the crude oil stream an effective amount of a reducing agent to convert at least a portion of the mercury into a volatile mercury;

wherein the mixing into the crude oil stream is prior to separating the crude oil stream into a gaseous hydrocarbon stream and a liquid hydrocarbon stream.

* * * * *